United States Patent [19]

Glaze

[11] Patent Number: 4,726,497

[45] Date of Patent: Feb. 23, 1988

[54] HOSIERY PROCESSING APPARATUS AND METHOD

[75] Inventor: John W. Glaze, Charlotte, N.C.

[73] Assignee: Intech Corporation, Charlotte, N.C.

[21] Appl. No.: 937,052

[22] Filed: Dec. 2, 1986

[51] Int. Cl.[4] ..... D06C 5/00

[52] U.S. Cl. ..... 223/60; 223/76

[58] Field of Search ..... 223/76, 75, 57, 60; 38/1 B, 144

[56] References Cited

U.S. PATENT DOCUMENTS 4,658,995 4/1987 Teague ..... 223/76

*Primary Examiner*—Louis K. Rimrodt

*Attorney, Agent, or Firm*—Banner, Birch, McKie & Beckett

[57] ABSTRACT

There is disclosed a method and apparatus for processing hosiery having synthetic fibers that are adapted to be steamed on forms for setting the fibers, in which there is provided a pressing operation for the hosiery for smoothing and reducing for example, the seam where the toe is closed by sewing. The pressing operation is applied after the initial application of steam to permit movement of the hosiery on the forms as the fibers shrink.

7 Claims, 9 Drawing Figures

HOSIERY PROCESSING APPARATUS AND METHOD

FIELD OF THE INVENTION

This invention relates to apparel treating and particularly to a method and apparatus for steaming hosiery on forms wherein there is provided a pressing operation for the purpose of smoothing and reducing the bulk of the seam in a sewn toe.

BACKGROUND OF THE INVENTION

In the manufacture of knitted hosiery, one method for closing the toe is by sewing. This is a relatively inexpensive process but to be sure that none of the courses of the knit fabric are skipped in the sewing operation, the sewing is done with a very fine feed which produces a relatively bulky seam.

Since closing a toe by sewing is less expensive than by looping, a sewn toe is generally associated with a lower quality product. Because the sewn toe is relatively bulky, it is also readily recognizable as well as relatively unattractive, which decreases its saleability.

This invention is directed primarily to a method and apparatus for improving the appearance of hosiery having sewn toes.

SUMMARY OF THE INVENTION

There is disclosed in my prior U.S. Pat. No. 4,524,889 a method for processing hosiery having synthetic fibers in which the hosiery is mounted on a form that is placed in a steam chamber where the fibers are shrunk on the form and are set. The steam chamber as disclosed is very flat, being deep enough only to accommodate the form with the hose. It is also high enough and wide enough only to receive for example one to three forms in tandem on a continuous chain-link conveyor. In this manner, the volume of the steam chamber is minimized, which reduces the steam requirements as well as the processing time.

In accordance with the present invention, there is added a pressing operation to the hosiery processing method and apparatus of my prior patent. With the flat configuration of the steam chamber, and the fact that the walls thereof are parallel to and relatively close to the flat sides of the forms, the hosiery can be readily pressed against the forms by pressing pads provided in the side walls of the steam chamber, which are adapted to be urged against the opposite faces of the form in pressing engagement with the hosiery.

Pressing not only smoothes the hosiery throughout the leg and foot portions but also flattens and thereby reduces the bulk of the seam in the toe, which improves the appearance of the hosiery and gives it a higher quality appearance.

Articles of apparel other than hosiery could of course also be processed on the apparatus in accordance with this invention, thereby shrinking and/or setting the fibers of the article on forms at the same time that the article is pressed.

DETAILED DESCRIPTION OF THE INVENTION

Figure 1:
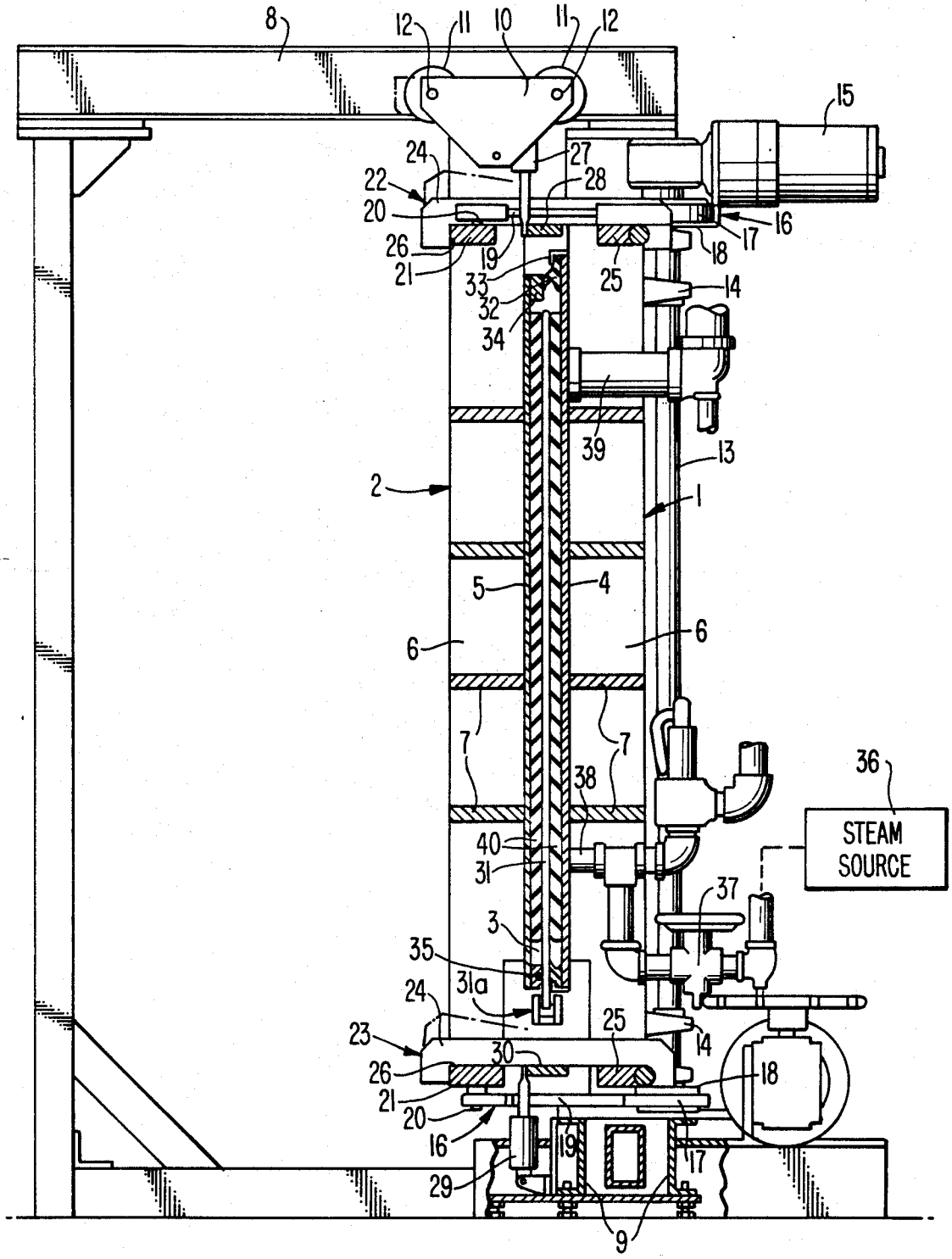
FIG. 1 is a sectional view through a steam chamber made in accordance with this invention.

With reference to FIG. 1, there is shown a portion of an apparatus for processing hosiery having synthetic fibers that are adapted to be shrunk and set on forms. The apparatus comprises opposed side walls, including the stationary side wall 1 and the movable side wall 2 of a steam chamber 3. The side walls are in the form of side plates 4 and 5 having vertical reinforcing ribs 6 and horizontal reinforcing ribs 7 on the outside faces thereof to support the plates against buckling during the steaming operation when steam under pressure is introduced into the steam chamber 3.

The vertical reinforcing rib 6 at the far side of the side wall 1 as seen in FIG. 1 is extended above the plate 4 and is secured to an I-beam 8 which is a part of the frame of the apparatus and is arranged transversely of the side walls 1 and 2. The vertical reinforcing rib 6 is also extended below the plate 4 and is secured to channel members 9 which are also a part of the frame of the apparatus. The vertical rib 6 (not shown) at the near edge of the side wall 1 is mounted in the same manner to the I-beam 8 and the channel members 9 so that the side wall 1 is thus rigidly supported.

The side wall 2 is movable toward and away from the side wall 1 between a position in which the steam chamber 3 is closed as shown in FIG. 1 and one in which it is open. To this end, the vertical reinforcing rib 6 at the far edge of side wall 2 as seen in FIG. 1 is extended above the plate 5 and is fastened to a plate 10 having wheels 11 journaled on shaft 12 and adapted to run on the horizontal webs of the I-beam 8. The vertical reinforcing rib 6 (not shown) at the front edge of the side wall 2 is also supported in the same manner on a second I-beam.

To move the side wall 2 between its open and closed positions, there is provided a shaft 13 spaced from the side wall 1 and generally parallel to its vertical center line. The shaft 13 is journaled for rotation in bearing lugs 14 carried for example by the stationary side wall 1. The shaft 13 is adapted to be rotated by a motor 15 carried by the frame between the I-beams 8 and is connected to the movable side wall 2 by an eccentric disc drive 16 at both the top and the bottom of the side wall 2. Each of the eccentric disc drives 16 has a strap portion 17 surrounding a circular disc 18 that is mounted eccentrically on the shaft 13. In each drive 16 a rod 19 is connected at one end to the strap 17 and at the other end is pivotally connected to a lug 20 on a bar 21 extending between the vertical reinforcing ribs 6 at the far and near edges of the side wall 2 as seen in FIG. 1. Accordingly, actuation of the motor 15 rotates the eccentric disc 18 which acts as a crank to impart reciprocation to the side wall 2 as the plate 10 is moved along the I-beam 8 between the full line position and the dotted line position shown in FIG. 1.

The movable side wall 2 is adapted to be locked in the closed position relative to the side wall 1 by a series of latches 22 at the top of the plate 5 and a similar series of latches 23 at the bottom of the plate 5. The latches 22 and 23 each comprise a latch member 24 pivotally mounted on a bar 25 similar to the bar 21 and extending between the vertical reinforcing ribs 6 at the front and rear edges of the stationary side wall 1 for pivotal movement between its latched and unlatched position as shown respectively in the full line and dotted line positions in FIG. 1. The free end of each latch member 24 is formed with a catch 26 that is adapted to overhang the edge of the bar 21 and thus lock the movable side wall 2 against movement away from the stationary side wall 1.

The latch members 24 of the latches 22 are adapted to be raised and lowered into and out of their latching position by a solenoid 27 depending from the frame and having its armature pivotally connected to a bar 28 underlying and connected to the latch members 24. The latch members 24 of the latches 23 are similarly raised and lowered by a solenoid 29 mounted on one of the channel members 9 and having its armature pivotally connected to a bar 30 underlying and connected to the latch members 24. When the solenoids 27 and 29 are alternately energized and de-energized, the free ends of the latch members 24 with the catches 26 are raised from and lowered into their latching positions with the bars 21.

Stockings are adapted to be moved into and out of the steam chamber 3 on flat forms 31, having the desired outline for the finished stocking and carried by a chain-link conveyor 31*a*. The forms are secured in an upstanding manner in series on the conveyor 31*a* and are arranged to move substantially parallel to the plates 4 and 5 which define the opposed interior walls of the steam chamber 3. When the plates 4 and 5 are in the closed position, the periphery of the steam chamber 3 is closed by a deformable seal 32 secured to the periphery of the plate 4 by retainers 33 and adapted to engage opposed sealing bars 34 on the plate 5. At the bottom of the steam chamber 3, the sealing bars 34 may be stepped to accommodate the forms 31 and, in the stepped portions, provided with gaskets 35.

Steam is introduced into the steam chamber 3 from a steam source 36 through a valve 37 and an inlet conduit 38. Steam is exhausted from the steam chamber 3 through an outlet conduit 39.

The steam chamber 3 is thus as narrow as possible consistent with the flow of steam into, through and out of the steam chamber 3 about the form 31 and a stocking thereon. The height of the steam chamber 3 is determined by the length of the forms 31 and the width is determined by the width of the forms and by the number of forms to be accommodated in the steam chamber 3 on each cycle, which preferably would not be more than two or three.

Mounted on the plates 4 and 5 in the steam chamber 3 are a pair of pressing pads that encompass the entire surface area of the forms 31 although, of course, for pressing less than all of the article, the pressing pads could be limited only to the portion of the stocking to be pressed, such as for example the foot portion only of the stockings. In one embodiment of the invention there is provided the pressing pads 40 that are formed of a compressible material that the steam will not penetrate, such as silicone rubber or neoprene foam. The pads 40 are thick enough so that when the movable side wall 2 is moved into the closed position, the pressing pads are compressed against the opposite faces of the form 31. They are also impervious to steam so that when subjected to steam under pressure, the pressing pads are compressed against the plates 4 and 5.

Figure 3A:
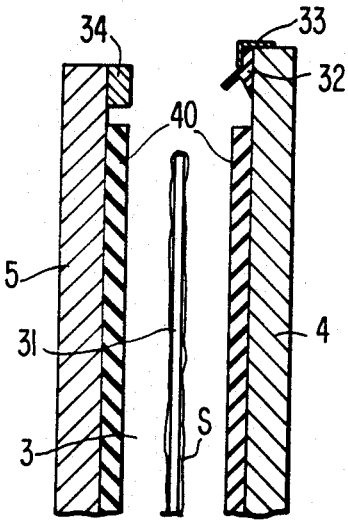
FIGS. 3A through 3D are fragmentary sectional views of the steam chamber of FIG. 1 showing successive steps in the pressing operation.

As shown in FIG. 3A when the movable side wall 5 is opened, the form 31 on which processing has been completed can be moved out of the steam chamber 3 and the next form 31 with a stocking S thereon is moved in.

Figure 3B:
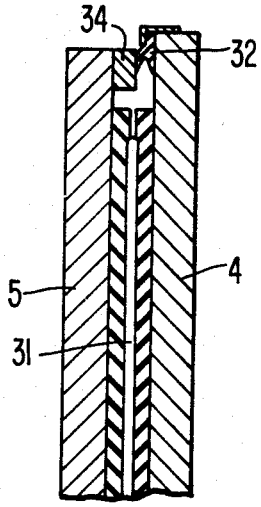
Figure 3C:
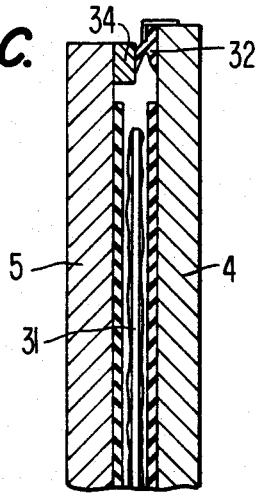

When the movable side wall 5 is moved to the closed position as shown in FIG. 3B, the pressing pads 40 are initially compressed against the form 31 to press the stocking against the form. When steam is applied, the steam pressure compresses the pressing pads 40 as shown in FIG. 3C so that the stocking S is free to move on the form 31 to adjust as the fibers are shrunk into contact with the form 31.

Figure 3D:
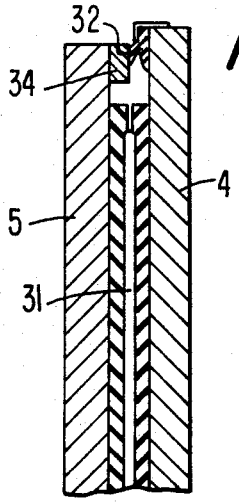

Steam is applied for the period of time required to set the fibers of the stocking at the steam temperature and pressure that is being used. Upon completion of the steaming after the fibers have been shrunk and set, the steam chamber 3 is exhausted whereupon the pressing pads 40 recover as shown in FIG. 3D thereby applying a substantially uniform pressing pressure for pressing the stocking against the form 31. The steam chamber is then opened as the movable side wall 5 is returned to the open position shown in FIG. 3A and the cycle is repeated.

Figure 2:
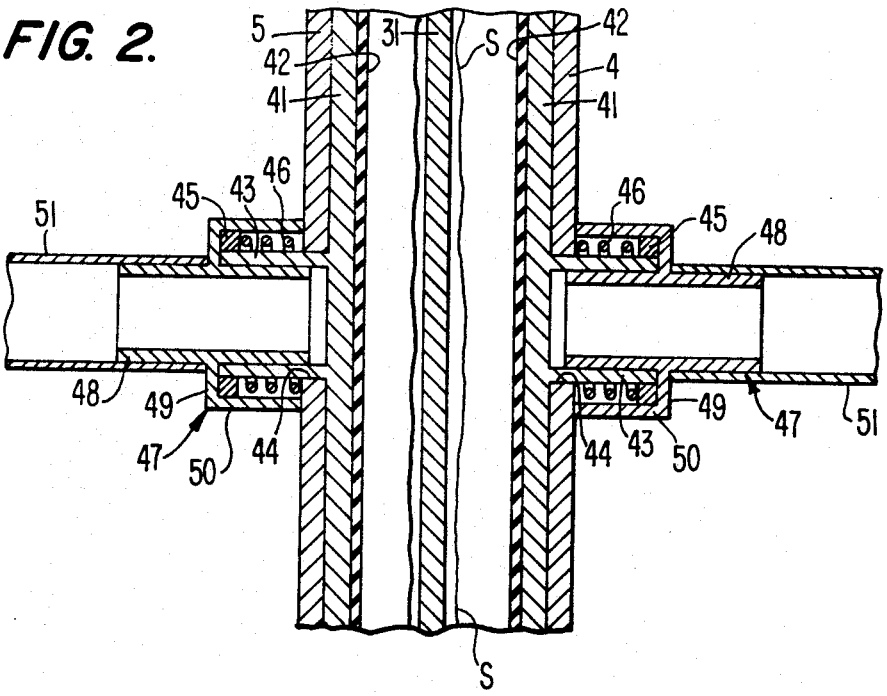
FIG. 2 is a detail view in section of a modification of the invention.

In FIG. 2 there is shown a modification of the invention in which the pressing pads are positively actuated. As shown, the pressing pads comprise a pair of pressing plates 41 which are preferably provided with a padded pressing surface 42. The pressing plates 41 are each supported respectively by one of the side plates 4 and 5 for movement toward and away from the form 31 by a sleeve 43 secured to the face of the plate 41 opposite from the pressing surface 42. Each of the sleeves 43 extends through an aperture 44 in the plate 4 or 5 and is provided with a collar 45 that forms an abutment for one end of a spring 46 coiled about the sleeve 43 and having its other end bearing against the adjacent face of the plate 4 or 5 for biasing the pressing plate 41 away from the form 31.

A fitting 47 has a tube 48 telescoping into the sleeve 43 and an outwardly extending flange 49 that carries a sleeve 50 overlaying the collar 45 and spring 46 and secured at its free end to the face of the side plate 4 or 5. A conduit 51 is connected to the free end of the tube 48 for conducting air or steam under pressure to the sleeve 43 and thereby urging the plate 4 or 5 toward the form 31.

While only one sleeve 43 is shown for each of the pressing plates 41, a number of sleeves could be used to provide a better distributed and more uniform pressing pressure or to focus the pressing pressure at a specific point such as the toe portion of the stockings.

Normally, the springs 46 urge the pressing plates 41 away from the form 31 and when pressure is applied through the conduit 51, the pressing plates are moved into pressing engagement with the form.

Figure 4A:
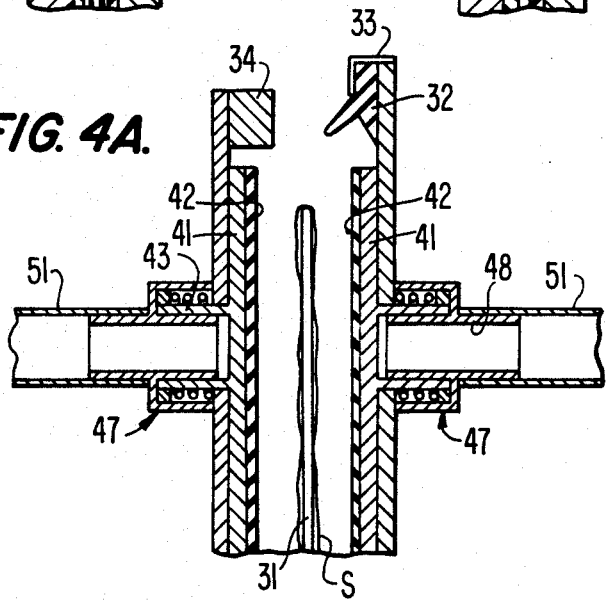
FIGS. 4A through 4C are fragmentary sectional views similar to FIGS. 3A through 3D showing the successive steps in the pressing operation with the modification shown in FIG. 2.
Figure 4B:
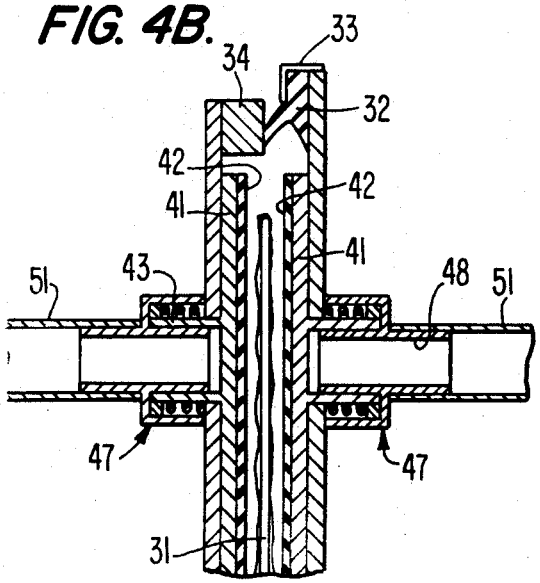
Figure 4C:
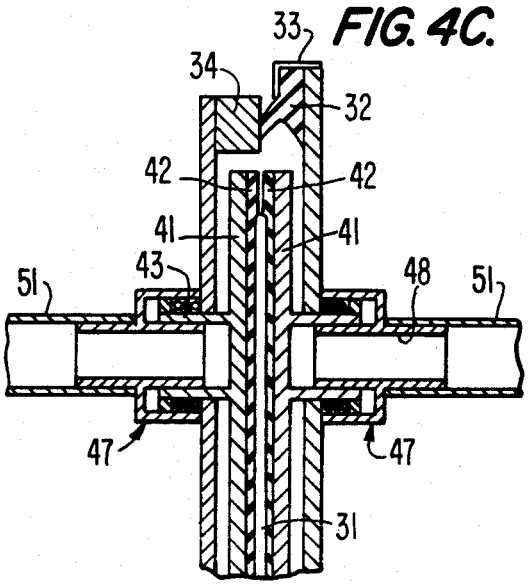

FIGS. 4A through 4C show a cycle of operation of the apparatus illustrated in FIG. 2.

As shown in FIG. 4A, when the movable side wall 5 is opened, there is no pressure applied to the pressing plates 41 and they are retracted by the springs 46 against the faces of the side plates 4 and 5. With the steam chamber open, the processed form 31 is removed from the steam chamber 3 and the next form 31 with a stocking S thereon is moved into the steam chamber.

When the movable side wall 5 is moved to the closed position as shown in FIG. 4B, and when steam is injected into the steam chamber 3, the pressing plates 41 remain in the retracted position against the faces of the side plates 4 and 5. The stocking is thus free to move on the form 31 to accommodate shrinkage.

Shortly after steam has been introduced into the steam chamber 3 and shrinkage of the stocking S on the form 31 has occurred, pressure is introduced to the tubes 48 through the conduits 51 to urge the pressing plates 41 against the form 31 to press the stocking on the form 31 as shown in FIG. 4C during the remainder of the steaming cycle while the fibers are set.

Upon completion of the steaming cycle, when steam to the steam chamber 3 is exhausted, pressure at the conduit 51 is also exhausted. The movable side wall 5 is then moved to the open position as shown in FIG. 4A and the cycle is repeated.

While the preferred embodiments of the invention herein described relate to an apparatus and method for treating hosiery, it could of course be used for processing other articles of wearing apparel. Other changes and additions within the scope of the invention will also be apparent to those skilled in the art.

I claim:

1. A method of setting synthetic fibers of an article of apparel comprising the steps of:

placing the article on a substantially flat form;

moving the form and article into a flat low-volume steam chamber while the steam chamber is open;

closing the steam chamber;

injecting into the steam chamber steam at a temperature and pressure and for a period of time sufficient to shrink and to set the synthetic fibers in the article while the article is free to move on the form;

applying pressure substantially uniformly over both faces of the article for pressing the article on the form;

exhausting the steam from the steam chamber; and opening the steam chamber and removing the form and article from the steam chamber.

2. A method in accordance with claim 1 wherein the pressure for pressing the article is applied at the time the steam is exhausted from the steam chamber and before the steam chamber is opened.

3. Apparatus for steam treating articles having synthetic fibers and for setting said fibers, comprising a steam chamber having a first side wall and as second side wall, means for moving one of said side walls toward and away from the other between a closed and an open position, means for sealing the periphery of said side walls when in the closed position to close said steam chamber, means for introducing steam into said chamber, a plurality of substantially flat forms conforming in outline generally to the articles to be treated and on which the articles are adapted to be mounted, means for moving the forms in succession into and out of the steam chamber between and substantially parallel to said side walls, said side walls being spaced apart in the closed position a distance to accommodate a form with an article thereon, and pressing means comprising pressing pads mounted on said side walls internally of said steam chamber and having pressing surfaces adapted to engage the opposite faces of the article on the form when the side walls are in the closed position for pressing the article on the form.

4. Apparatus in accordance claim 3 having means for actuating the pressing means to engage the article after the initial application of steam whereby the article on the form is free to move relative to the form.

5. Apparatus in accordance with claim 3 wherein the pressing pads are compressible and are adapted to be compressed out of engagement with the article by the steam under pressure in the steam chamber whereby the steam compresses the pads away from the article and to expand into engagement with the article on the form when the steam is exhausted and thereby press the article.

6. Apparatus in accordance with claim 3 wherein the pressing pads are mounted on and for movement toward and away from said side walls, and means are provided for urging said pads with the pressing surfaces thereof into engagement with the article on the form when the side walls are in the closed position.

7. Apparatus in accordance with claim 6 having spring means for retracting said pressing plates from engagement with the article.

* * * * *